US011835313B2

(12) United States Patent
Irwin

(10) Patent No.: US 11,835,313 B2
(45) Date of Patent: Dec. 5, 2023

(54) TRIGGER FOR A FIREARM

(71) Applicant: Michael Burke Irwin, Bagdad, KY (US)

(72) Inventor: Michael Burke Irwin, Bagdad, KY (US)

( * ) Notice: Subject to any disclaimer, the term of this patent is extended or adjusted under 35 U.S.C. 154(b) by 120 days.

(21) Appl. No.: 17/497,043

(22) Filed: Oct. 8, 2021

(65) Prior Publication Data

US 2022/0113104 A1 Apr. 14, 2022

Related U.S. Application Data

(60) Provisional application No. 63/198,276, filed on Oct. 8, 2020.

(51) Int. Cl.

| | |
|---|---|
| ***F41A 19/10*** | (2006.01) |
| ***F41A 19/16*** | (2006.01) |
| ***F41A 19/12*** | (2006.01) |

(52) U.S. Cl.

CPC ..... *F41A 19/10* (2013.01); *F41A 19/12* (2013.01); *F41A 19/16* (2013.01)

(58) Field of Classification Search

CPC ..... F41A 19/10; F41A 19/12; F41A 19/16

See application file for complete search history.

(56) References Cited

U.S. PATENT DOCUMENTS

| | | | | |
|---|---|---|---|---|
| 2,117,218 | A * | 5/1938 | Sanders | F41A 19/45 89/144 |
| 2,855,716 | A * | 10/1958 | Campbell | F41A 19/45 89/144 |
| 2,858,741 | A * | 11/1958 | Simpson | F41A 19/46 89/149 |
| 3,377,731 | A * | 4/1968 | Lawrence | F41C 7/06 42/20 |
| 3,662,483 | A * | 5/1972 | Seecamp | F41C 7/06 42/1.04 |
| 4,017,996 | A * | 4/1977 | Liedke | F41A 19/45 89/144 |
| 4,151,670 | A * | 5/1979 | Rath | F41A 19/00 42/70.01 |
| 5,857,280 | A * | 1/1999 | Jewell | F41A 19/45 42/70.05 |
| 7,562,614 | B2 * | 7/2009 | Polston | F41A 19/33 89/154 |
| 8,220,193 | B1 * | 7/2012 | Lynch | F41A 19/16 42/70.08 |
| 9,267,750 | B1 * | 2/2016 | Tubb | F41A 17/56 |
| 2021/0278157 | A1 * | 9/2021 | Dextraze | F41A 19/12 |
| 2022/0113104 | A1 * | 4/2022 | Irwin | F41A 19/10 |

* cited by examiner

*Primary Examiner* — Joshua E Freeman
*Assistant Examiner* — Benjamin S Gomberg
(74) *Attorney, Agent, or Firm* — Dinsmore & Shohl LLP

(57) ABSTRACT

The embodiments described herein include a trigger assembly for a firearm including a rotatable disconnector biased by a detent ball and a return spring to reset the trigger, whereby resetting said trigger causes the rotation of said disconnector to completely decompress said return spring thereby providing no spring pressure on the trigger.

5 Claims, 6 Drawing Sheets

TRIGGER FOR A FIREARM

BACKGROUND OF THE INVENTION

Field of the Invention

The invention relates generally to an assembly of trigger components for a firearm and more particularly to a trigger assembly for a semi-automatic firearm that facilitates a reduced felt trigger pull for more accurate firing of the firearm.

Description of the Related Art

A wide variety of trigger mechanisms for firearms have been employed to discharge the firearm at a specific moment in time during the process of aiming the firearm and discharging a bullet or projectile (the shot) to its intended target. To discharge the shot at the exact moment in time desired, many triggers have been developed with a minimal amount of pressure required to release the firing mechanism. The amount of pressure required to actuate the trigger mechanism and initiate discharge of the firearm is often termed a "trigger pull weight" or "felt pressure". Very light felt trigger pressure is often referred to as a "hair trigger. These light weight triggers only require the slightest pressure from a shooter's finger to actuate the trigger mechanism and discharge the firearm.

Typical prior art trigger designs all require return pressure, generally supplied by a compression spring, to allow a trigger surface that is depressed by a finger of the shooter (often simply called the "trigger") to return to the correct position after pressure from the shooter's finger is released and the firing mechanism is re-cocked in preparation for firing the next shot. This is especially true with a semi-automatic firearm trigger, as the firing mechanism is automatically reset during the firing process and the trigger itself, generally working in tandem with a disconnector, must be reset after pressure from the shooter's finger is removed by moving forward via forward pressure of a spring. As a result of this reset spring mechanism, the trigger pull weight cannot be reduced below the needed forward pressure required to reset the trigger. This limitation is exacerbated in semi-automatic triggers in order to allow successful functioning with a disconnector mechanism.

Furthermore, it is also advantageous to allow the trigger to be adjustable for a specific amount of force needed to discharge the firearm, or trigger pull weight. A typical way to achieve adjustability of trigger pull weight is to position a threaded fastener, such as a set-screw, behind the spring providing the forward pressure on the trigger. Rotating the set-screw to further compress the return spring increases the trigger pull weight, while rotating the set-screw in the opposite direction necessarily reduces the compression of the return spring and thus reduces the trigger pull weight. In this way, a desired trigger pull can be obtained by the shooter. However, in all these prior art trigger mechanisms the reduction of the trigger pull weight is limited by the minimal amount of return spring pressure needed to reset the trigger, as explained above.

Accordingly, a need exists in the art for a trigger assembly of a firearm that will successfully reset the trigger via forward spring pressure whereby after successful resetting of the trigger is achieved, the forward spring pressure is eliminated from the trigger thereby allowing a minimal trigger pull weight. Furthermore, while this minimal felt trigger pull is provided when desired, a need also exists to provide adjustability of the felt trigger pull weight by gradually increasing the compression of the return spring until it produces pressure on the trigger after resetting until the heavier pull weight desired is achieved. In either of these scenarios, the trigger assembly, including a disconnector used in a semi-automatic firearm application, must function reliably over many repeated uses thereby allowing safe and accurate firing of the firearm.

SUMMARY OF THE INVENTION

The embodiments described herein disclose a trigger assembly for a firearm that resets a trigger thereof after firing through operation of forward spring pressure. After the trigger is reset the novel mechanism eliminates forward spring pressure from the trigger thereby allowing a minimal trigger pull weight. Additionally, in some aspects the minimal felt trigger pull is adjustable by gradually increasing the compression of the return spring until it produces a desired pressure on the trigger after resetting. Other aspects and embodiments are set forth in the detailed description below taken in conjunction with the Drawing Figures.

BRIEF DESCRIPTION OF THE DRAWING FIGURES

DETAILED DESCRIPTION OF THE PREFERRED EMBODIMENT(S)

Figure 1:
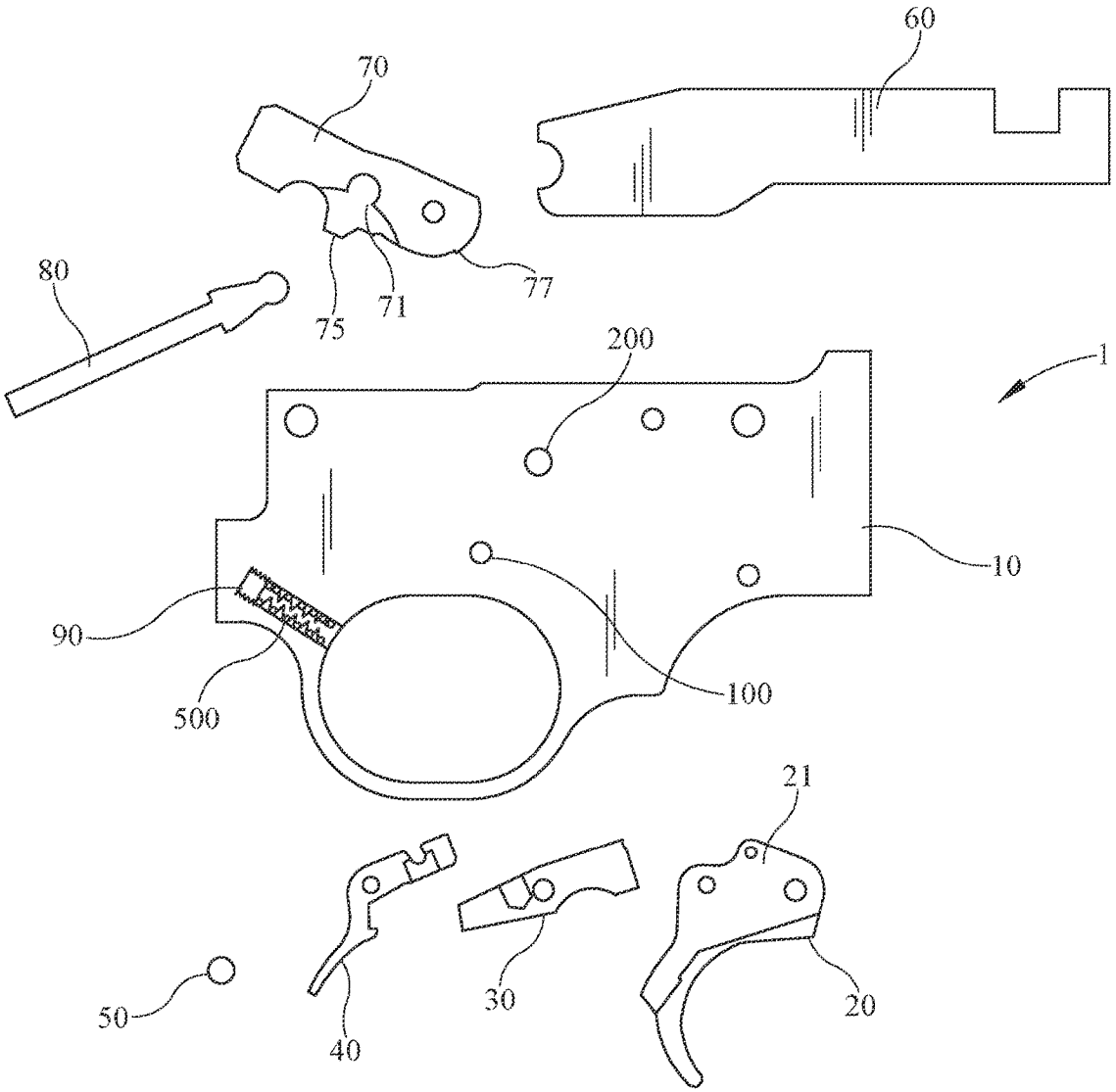
FIG. 1 is an exploded side sectional view of a trigger assembly and a bolt in accordance with some embodiments.
Figure 2:
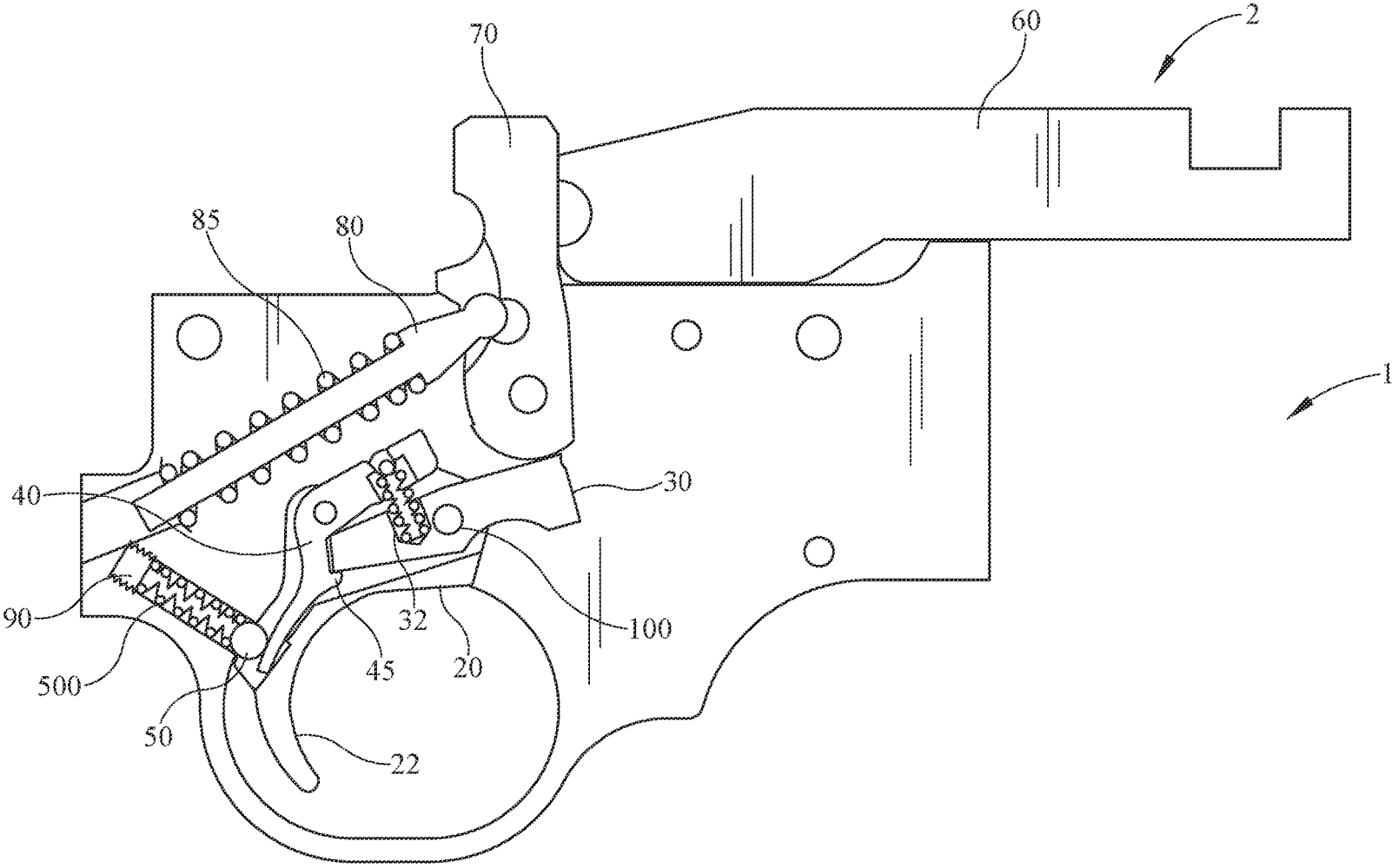
FIG. 2 is a side sectional view of a trigger assembly and a bolt in accordance with some embodiments.
Figure 3:
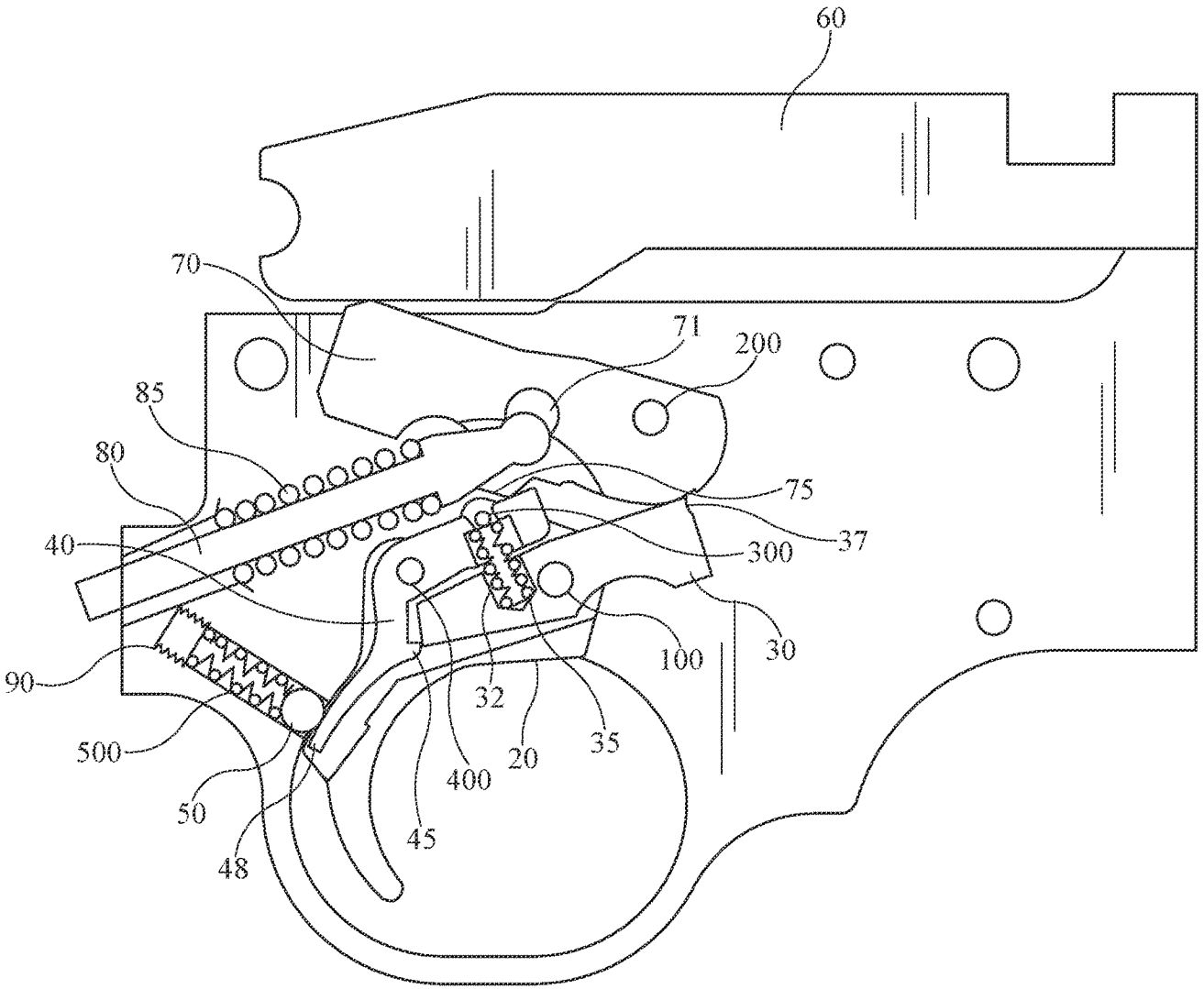
FIG. 3 is a sectional detailed view of a trigger assembly and a bolt in accordance with some embodiments.

Referring now to FIGS. 1 and 2, and in accordance with various embodiments and aspects, a trigger assembly 1 for a semi-automatic rifle 2 is shown in a front sectional view. It should be noted that while the assembly 1 is depicted and described in the context of a portion of a semi-automatic rifle 2, a wide variety of firearms that require trigger assemblies may be employed with the various embodiments described herein without departing from the scope of the embodiments or limiting their application. Trigger assembly 1 includes a trigger housing 10 and a bolt 60. Irrelevant details of bolt 60 are not depicted in the drawing Figs. for purposes of clarity. Trigger housing 10 includes a fixed interior trigger-pin 100 and a hammer-pin 200, and a set-screw 90 disposed in and angled towards a bottom rear portion of trigger housing 10.

Referring to FIGS. 1-6, and in some exemplary embodiments trigger assembly 1 further includes a trigger shoe 20 held by and partially rotatable around trigger pin 100, the trigger shoe having a cavity 21 present along a top portion thereof to receive a sear 30 and a disconnector 40. Disconnector 40 is rotatable around a disconnector pin 400, and is actuated by a detent ball 50 operating under force of a return spring 500 and set screw 90. Disconnector 40 further includes a paddle surface 48 extending rearwardly and downwardly adjacent trigger shoe 20. Trigger assembly 1 further includes a hammer 70 with a bump-surface 75, an engagement-surface 77, and a strut-seat 71 to receive and engage a hammer strut 80.

Referring now to FIGS. 2 through 6 and in accordance with some aspects and embodiments trigger assembly 1 engages with a bolt 60, depicted in a forward position that is ready for firing. Hammer 70 is capable of clock-wise rotation to a strike position at a rear of bolt 60 through operation of pressure or force provided by hammer-spring 85, which is disposed around and biases hammer strut 80. The "strike position" of hammer 70 is the action that fires a bullet or other projectile being fired in the firearm 2. Hammer 70 movement is effected by the clock-wise rotation of trigger shoe 20. Sear 30 is locked into position at disconnector locking-seat 45 of disconnector 40, and sear 30, trigger shoe 20 and disconnector 40 are all rotated clock-wise around the axis of trigger-pin 100 when finger pressure upon surface 22 of said trigger shoe 20 is applied, as would happen during a typical discharge of a firearm. Furthermore, a sear spring 35 is disposed between a trigger cross-pin 300 and a pocket 32 within sear 30 thereby biasing sear 30 and trigger shoe 20 against one another.

Referring again to FIGS. 1 and 3, a bolt 60 is depicted having completed its rearward travel under pressure as would be typical of a blow-back semi-automatic firearm discharge. Bolt 60 rearward movement causes counter clock-wise movement of hammer 70 around hammer-pin 200, thereby compressing hammer spring 85 around hammer strut 80. Hammer strut 80 is thereby pushed rearwardly at strut-seat 71 of said hammer 70. Once the maximum counter clock-wise rotation of hammer 70 occurs, bump-surface 75 of hammer 70 contacts a top surface of disconnector 40, thereby rotating disconnector 40 clock-wise around disconnector pin 400 and thus releasing sear 30 from locking-seat 45 of disconnector 40. Furthermore, this clock-wise motion of paddle surface 48 compresses detent ball 50 into return-spring 500 which is held captive by set-screw 90.

Upon the release of sear 30 from locking-seat 45, sear 30 then rotates counter clock-wise around trigger-pin 100 under downward pressure from sear-spring 35 which is held captive by trigger cross-pin 300. The counter clock-wise rotation of sear 30 stops as engagement-surface 37 of sear 30 makes contact along the bottom surface of hammer 70. All the above described motion has no effect on the position of trigger shoe 20, still held in a rear position as would be the case during firing.

Figure 4:
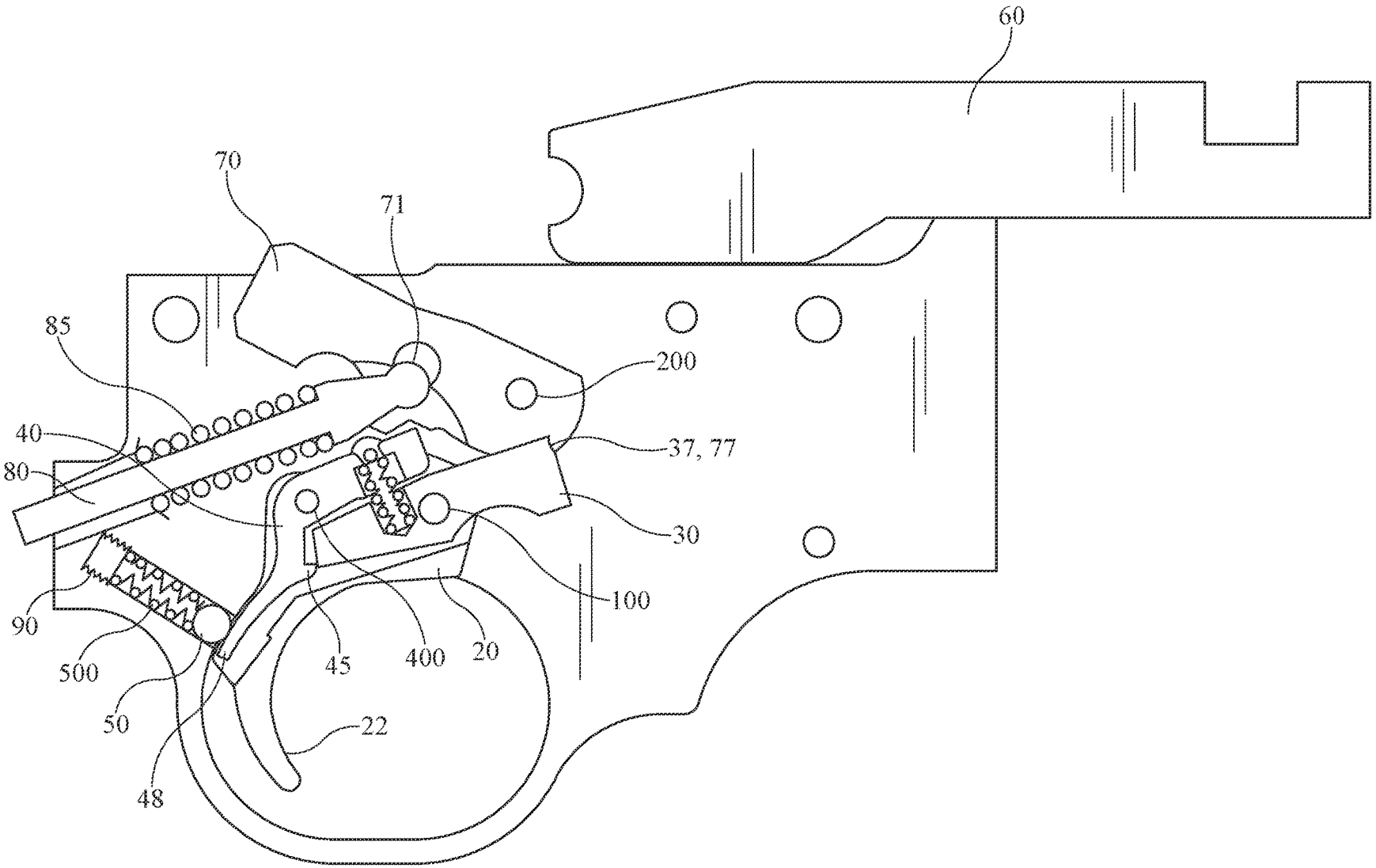
FIG. 4 is a side sectional view of a trigger assembly and a bolt in accordance with some embodiments.

Referring now to FIGS. 1 and 4, bolt 60 is depicted to have completed its forward travel via a conventional charging handle and spring (not shown) as would be typical of a semi-automatic firearm mechanism. The forward travel of bolt 60 thereby allows hammer 70 to rotate clock-wise around hammer-pin 200 under forward pressure of hammer strut 80 via hammer-spring 85. Clock-wise rotation of hammer 70 is stopped by the contact of engagement-surface 37 of sear 30 with engagement-surface 77 of hammer 70. Pressure supplied by hammer-spring 85 is thereby held against sear 30 and trigger-pin 100, thereby holding sear 30 in a static position, while trigger shoe 20 and disconnector 40 still maintain the ability to rotate counter clock-wise together around trigger-pin 100 once finger pressure to surface 22 of trigger shoe 20 is released. Bottom paddle-surface 48 of disconnector 40 is held in a clock-wise rotation position relative to trigger shoe 20 by disconnector-pin 400 and the released condition from locking-seat 45 of disconnector 40, thereby compressing detent ball 50 into return-spring 500.

Figure 5:
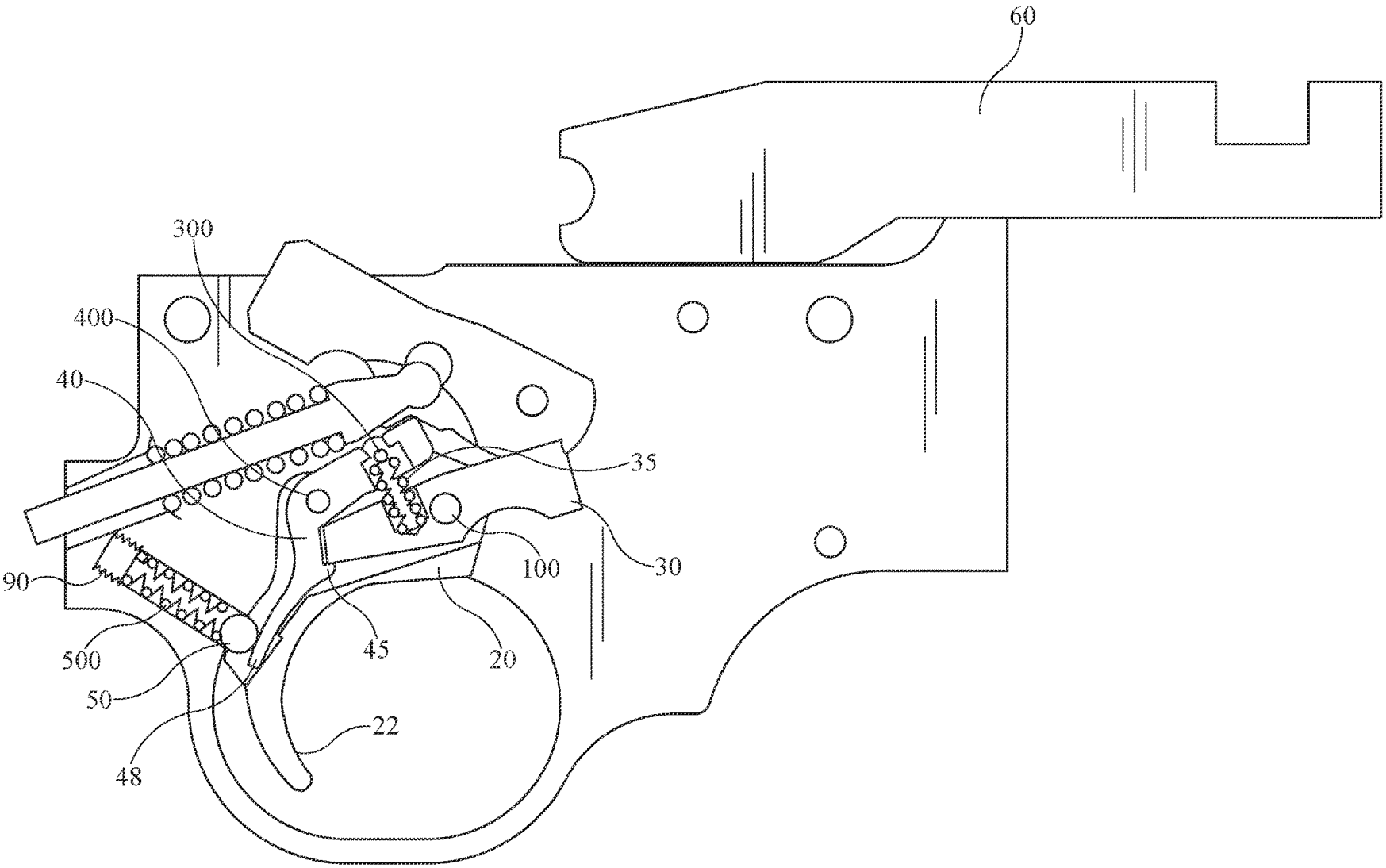
FIG. 5 is a side sectional view of a trigger assembly and a bolt in accordance with some embodiments.
Figure 6:
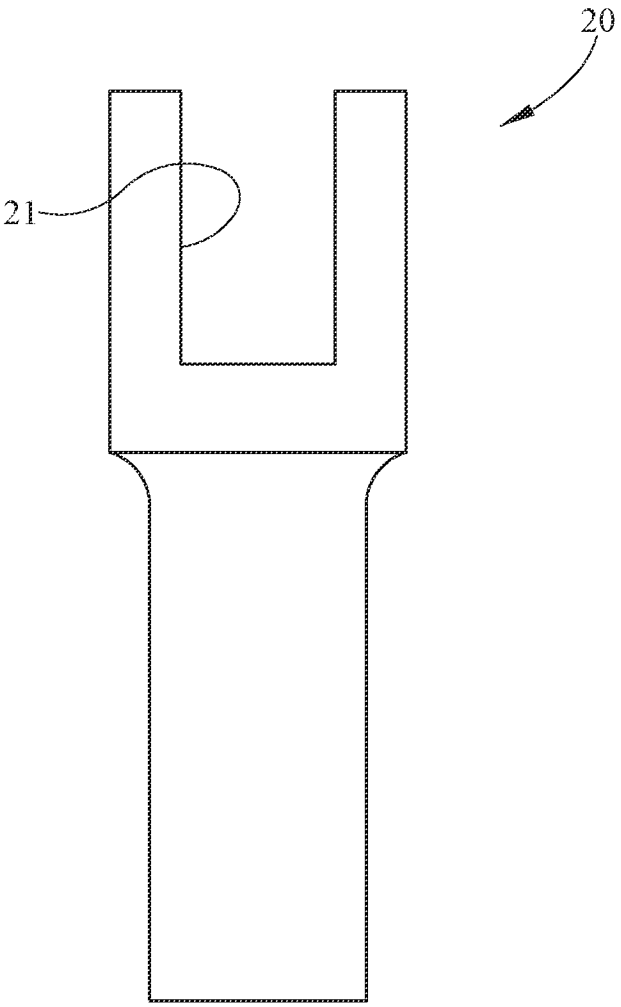
FIG. 6 is a front view of a trigger shoe in accordance with some embodiments.

Referring now to FIGS. 1 and 5, and in accordance with some aspects and embodiments, pressure (via a finger or the like) to surface 22 of trigger shoe 20 has been released, thereby allowing return spring 500 to decompress and thereby moving detent ball 50 forward upon surface 48 of disconnector 40. Disconnector 40 is engaged to said trigger shoe 20 by disconnector-pin 400 such that it thereby rotates trigger shoe 20 counter-clockwise around trigger-pin 100. Forward surface of locking-seat 45 of disconnector 40 is then able to slip or glide along the rear surface of sear 30, until locking seat 45 forward surface clears and permits said disconnector 40 locking seat 45 to engage and lock to said sear 30.

As trigger shoe 20 rotates counter clock-wise around trigger-pin 100, simultaneously disconnector 40 is permitted to rotate counter clock-wise around disconnector-pin 400. Both of these counter clock-wise rotations are complete when sear 30 and locking-seat 45 of said disconnector 40 engage each other. Furthermore, the simultaneous counter clock-wise rotation of sear 30 and disconnector 40 completely decompresses return-spring 500. The remaining force required to complete the counter clock-wise rotation is provided by sear-spring 35, which provides counter clock-wise force to trigger shoe 20 at trigger cross-pin 300.

Therefore, in accordance with some aspects and embodiments the trigger assembly with the movements of components described above provide a firearm that is now ready for discharge, i.e., "cocked", with no return spring tension detected during the trigger pull. Furthermore, the ability to add return pressure and increase detected trigger pull pressure is readily made available by simply adjusting set-screw 90 to further compress return-spring 500. This feature of the various embodiments thereby prevents complete decompression of return-spring 500 during the resetting of the trigger while enabling further compression of return-spring 500 permitted until the desired trigger pull weight is achieved.

While the present invention has been shown and described herein in what are considered to be the exemplary embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A trigger assembly for a firearm having a trigger, said trigger assembly comprising:

a rotatable disconnector biased by a detent ball and a return spring to reset said trigger, whereby resetting said trigger causes the rotation of said disconnector to completely decompress said return spring thereby providing no spring pressure on said trigger and;

a rotatable trigger shoe engaging said disconnector and a rotatable sear also engaged by both said trigger shoe and said disconnector, whereby the rotation of said disconnector decompresses said return spring thereby providing no spring pressure on said trigger shoe.

2. The trigger assembly of claim 1 wherein said disconnector has a surface that is engaged by said detent ball return spring for resetting said trigger.

3. The trigger assembly of claim 2 comprising:

a set screw capable of rotation to compress or decompress said return spring, thereby providing an adjustable felt trigger pull.

4. The trigger assembly of claim 3 comprising:

the trigger shoe having a cavity therein along a top portion thereof, said cavity engaging both said sear and said disconnector.

5. The trigger assembly of claim 4 comprising:

a sear spring disposed between and engaged on either end thereof by said sear and said trigger shoe, said sear spring facilitating the rotation of said disconnector to completely decompress said return spring.

* * * * *